US010697240B2

(12) United States Patent
Winslow

(10) Patent No.: US 10,697,240 B2
(45) Date of Patent: Jun. 30, 2020

(54) STEERING FORCE CONTROL MECHANISM FOR A DOWNHOLE DRILLING TOOL

(71) Applicant: HALLIBURTON ENERGY SERVICES, INC., Houston, TX (US)

(72) Inventor: Daniel Martin Winslow, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 316 days.

(21) Appl. No.: 15/580,229

(22) PCT Filed: Jul. 29, 2015

(86) PCT No.: PCT/US2015/042741
§ 371 (c)(1),
(2) Date: Dec. 6, 2017

(87) PCT Pub. No.: WO2017/019073
PCT Pub. Date: Feb. 2, 2017

(65) Prior Publication Data

US 2018/0163473 A1 Jun. 14, 2018

(51) Int. Cl.
*E21B 4/00* (2006.01)
*E21B 7/06* (2006.01)
*E21B 4/02* (2006.01)

(52) U.S. Cl.
CPC ..... *E21B 4/003* (2013.01); *E21B 4/02* (2013.01); *E21B 7/067* (2013.01)

(58) Field of Classification Search
CPC . E21B 7/067; E21B 7/062; E21B 7/04; E21B 7/06
See application file for complete search history.

(56) References Cited

U.S. PATENT DOCUMENTS 3,298,449 A * 1/1967 Bachman ..... E21B 7/062 175/76
3,457,999 A * 7/1969 Massey ..... E21B 7/067 175/61

(Continued)

FOREIGN PATENT DOCUMENTS

EP 2242893 B1 4/2012

OTHER PUBLICATIONS

Korean Intellectual Property Office, International Search Report and Written Opinion, dated Apr. 21, 2016, 18 pages, International Application PCT/US2015/042741, Korea.

*Primary Examiner* — Kipp C Wallace

(57) ABSTRACT

Systems and methods of counteracting downhole reactive forces within a directional drilling tool are disclosed. The directional drilling tool includes a steering mechanism for selectively pivoting a bit shaft with respect to an elongate housing. A preloaded flexible member may be provided between an upper end of the bit shaft and an elongate housing to counteract reactive forces applied by a geological formation on a drill bit at a lower end of the bit shaft. Where sufficient reactive forces are transmitted through the bit shaft to overcome the preload, the flexible member will be induced to flex, permitting some movement of the upper end of the bit shaft. This movement limits the force that may be applied by the steering mechanism, which can extend the useful life of the directional drilling tool and may permit the power required to drive the drill bit to be maintained at a consistent value.

12 Claims, 5 Drawing Sheets

(56) References Cited

U.S. PATENT DOCUMENTS

| | | | | |
|---|---|---|---|---|
| 3,650,338 | A * | 3/1972 | McNeely, Jr. | E21B 7/062 175/76 |
| 3,967,680 | A * | 7/1976 | Jeter | E21B 4/00 175/38 |
| 4,732,223 | A * | 3/1988 | Schoeffler | E21B 7/062 175/256 |
| 5,113,953 | A | 5/1992 | Noble | |
| 5,168,941 | A | 12/1992 | Krueger et al. | |
| 5,520,255 | A | 5/1996 | Barr et al. | |
| 5,875,859 | A | 3/1999 | Ikeda et al. | |
| 6,116,354 | A | 9/2000 | Buytaert | |
| 6,158,529 | A | 12/2000 | Dorel | |
| 6,244,361 | B1 | 6/2001 | Comeau et al. | |
| 6,364,034 | B1 * | 4/2002 | Schoeffler | E21B 4/006 175/101 |
| 7,188,685 | B2 | 3/2007 | Downton et al. | |
| 7,866,415 | B2 | 1/2011 | Peters | |
| 2002/0043372 | A1 | 4/2002 | Cargill et al. | |
| 2004/0262043 | A1 | 12/2004 | Schauf | |
| 2011/0139513 | A1 * | 6/2011 | Downton | E21B 7/067 175/61 |
| 2011/0308858 | A1 * | 12/2011 | Menger | E21B 7/067 175/24 |
| 2015/0226020 | A1 * | 8/2015 | Crowley | E21B 7/067 175/40 |
| 2016/0060960 | A1 * | 3/2016 | Parkin | E21B 17/10 175/24 |
| 2017/0247948 | A1 * | 8/2017 | Gharib | E21B 36/001 |
| 2017/0275948 | A1 * | 9/2017 | Bryson | E21B 7/062 |
| 2018/0155986 | A1 * | 6/2018 | Gharib | E21B 7/04 |

* cited by examiner 22
10
28
30
38
36
"S"
12a
"G"
12
40
"X0"
12b
32
"X1"
102
"F"
12c
18
104
"X2"
100
14

STEERING FORCE CONTROL MECHANISM FOR A DOWNHOLE DRILLING TOOL

CROSS-REFERENCE TO RELATED APPLICATIONS

This application is a U.S. national stage patent application of International Patent Application No. PCT/US2015/042741, filed on Jul. 29, 2015 the benefit of which is claimed and the disclosure of which is incorporated herein by reference in its entirety.

BACKGROUND

Field of the Invention

The present disclosure relates generally to downhole operations related to oil and gas exploration, drilling and production. More particularly, embodiments of the disclosure relate to systems and methods related to counteracting lateral forces realized by a drill bit in directional drilling devices within a directional drilling tool.

Background

Often in operations for the exploration, drilling and production of hydrocarbons, a wellbore is initially drilled along a first axis and is deviated from the first axis at an appropriate depth to permit the wellbore to arrive at a targeted subterranean location. For example, a wellbore may initially be drilled along a vertical axis, and may be deviated from the vertical axis to extend generally horizontally or obliquely to maximize the distance the wellbore extends through a particular hydrocarbon bearing formation. Also, directional drilling techniques may be employed where geological conditions call for a wellbore that extends along trajectory other than the path the wellbore would otherwise take without deliberately steering the drilling device.

Although directional drilling devices are often employed to deviate a wellbore from a straight path, these directional drilling devices may also be employed where the intended trajectory of the wellbore is entirely vertical or straight. For example, in a straight drilling operation, downhole geologic conditions, which may be largely unpredictable, can cause a drill bit to veer off the intended straight drilling trajectory. Also intermittent or changing forces applied to the drill bit by the drill string or by the drilling fluids can cause the drill bit to veer off the intended straight trajectory. The directional drilling devices may then be employed to steer the drill bit back to the intended straight trajectory.

Directional drilling devices are often characterized as "point the bit" devices or "push the bit" devices. Point the bit devices generally employ a steering mechanism operable to selectively pivot a rotational axis of the drill bit with respect to a drill string housing axis near the drill bit. The deviation causes the wellbore to deviate from a trajectory along the drill string housing axis. Push the bit devices drill generally employ a steering mechanism operable to apply lateral forces to the wellbore walls to cause the drill bit to drill in a particular direction. Both types of devices cause lateral drilling forces to be applied to the drill bit to steer the drill bit in a particular direction.

Often, only a portion of the lateral steering forces applied to the drill bit is useful in removing the surrounding geologic formation to drill the wellbore. Excess lateral force applied to a drill bit may be associated with higher than necessary power requirements to drive the drill bit and unnecessary wear on the drill bit, bearing surfaces in the directional drilling system and other system components.

BRIEF DESCRIPTION OF THE DRAWINGS

The disclosure is described in detail hereinafter on the basis of embodiments represented in the accompanying figures, in which.

DETAILED DESCRIPTION

Figure 1:
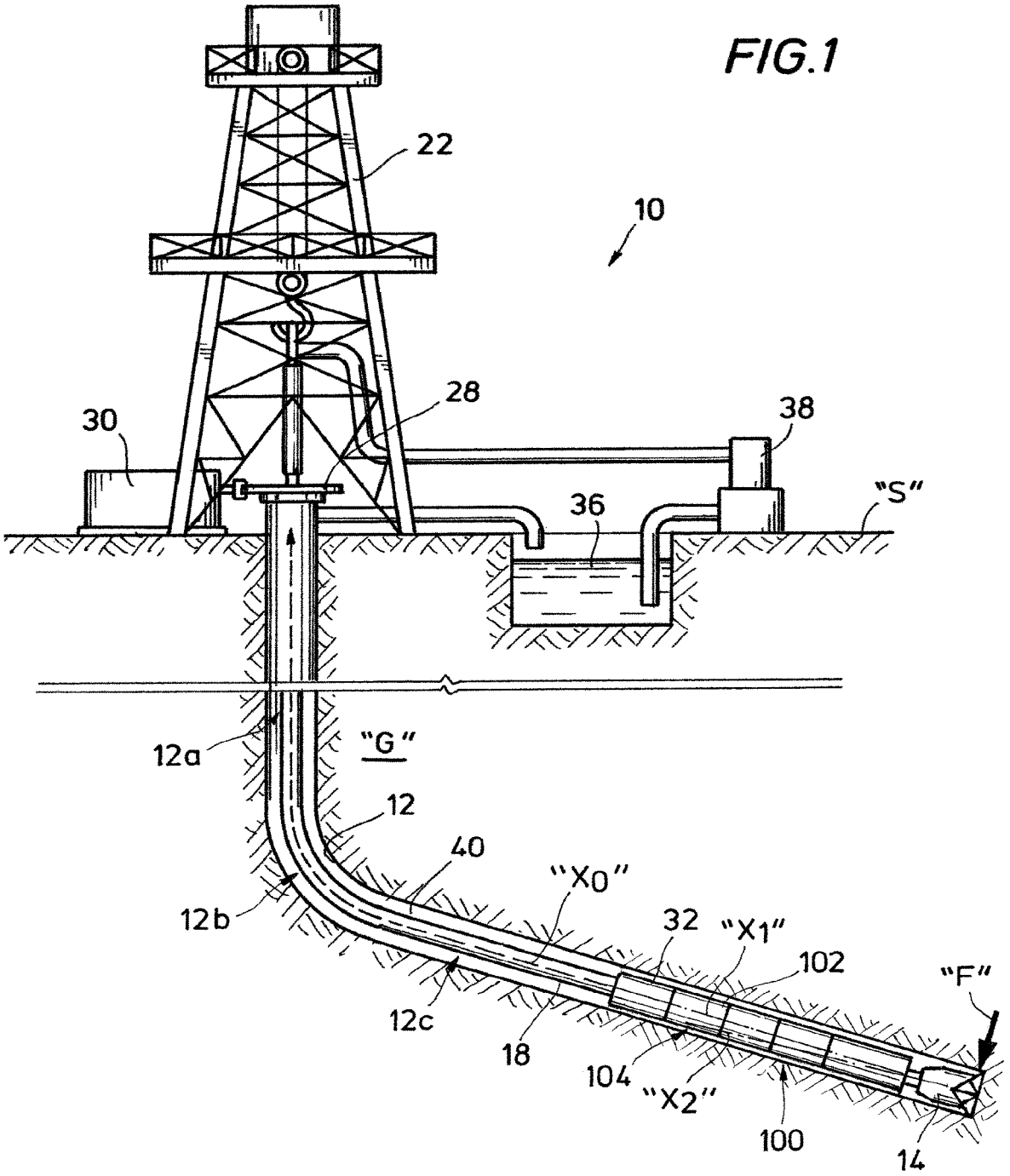
FIG. 1 is a partial cross-sectional schematic side view of a drilling system including a downhole directional drilling system having a drill bit and a steering force control mechanism in accordance with one or more exemplary embodiments of the disclosure.

The disclosure may repeat reference numerals and/or letters in the various examples or Figures. This repetition is for the purpose of simplicity and clarity and does not in itself dictate a relationship between the various embodiments and/or configurations discussed. Further, spatially relative terms, such as beneath, below, lower, above, upper, up-hole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the up-hole direction being toward the surface of the wellbore, the downhole direction being toward the toe of the wellbore. Unless otherwise stated, the spatially relative terms are intended to encompass different orientations of the apparatus in use or operation in addition to the orientation depicted in the Figures. For example, if an apparatus in the Figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover even though a Figure may depict a wellbore in a vertical wellbore, unless indicated otherwise, it should be understood by those skilled in the art that the apparatus according to the present disclosure is equally well suited for use in wellbores having other orientations including vertical wellbores, slanted wellbores, multilateral wellbores or the like. Likewise, unless otherwise noted, even though a Figure may depict an offshore operation, it should be understood by those skilled in the art that the apparatus according to the present disclosure is equally well suited for use in onshore operations. Further, unless otherwise noted, even though a Figure may depict a cased hole, it should be understood by those skilled in the art that the apparatus according to the present disclosure is equally well suited for use in open-hole operations.

Description of Exemplary Embodiments

Referring to FIG. 1, a drilling system 10 is illustrated that includes a downhole directional drilling tool 100, in accordance with one or more embodiments of the present disclosure. Although drilling system 10 is illustrated in the context of a terrestrial drilling operation, it will be appreciated by those skilled in the art that aspects of the disclosure may be also practiced in connection with offshore platforms and or other types of hydrocarbon exploration and recovery systems as well. Also, it will be appreciated by those skilled in the art that although the directional drilling tool 100 is described below as being coupled in a drill string, that other types of conveyances, e.g., coiled tubing, are contemplated for delivering directional drilling tool 100 downhole as well.

Directional drilling system 10 is partially disposed within a directional wellbore 12 traversing a geologic formation "G." The directional wellbore 12 extends from a surface location "S" along a curved longitudinal axis $X_0$ to define a vertical section 12*a*, a build section 12*b* and a tangent section 12*c*. The tangent section 12*c* is the deepest section of the wellbore 12, and generally exhibits lower build rates (changes in the inclination of the wellbore 12) than the build section 12*b*. In some exemplary embodiments (not shown), the tangent section 12*c* is generally horizontal. Additionally, in one or more other exemplary embodiments, the wellbore 12 includes a wide variety of vertical, directional, deviated, slanted and/or horizontal portions therein, and may extend along any trajectory through the geologic formation "G."

A rotary drill bit 14 is provided at a downhole location in the wellbore 12 (illustrated in the tangent section 12*c*) for cutting into the geologic formation "G." When rotated, the drill bit 14 operates to break up and generally disintegrate the geological formation "G." At the surface location "S" a drilling rig 22 is provided to facilitate rotation of the drill bit 14 and drilling of the wellbore 12. The drilling rig 22 includes a turntable 28 that generally rotates the drill string 18 and the drill bit 14 together about the longitudinal axis $X_0$. The turntable 28 is selectively driven by an engine 30, chain drive system, or other apparatus. Rotation of the drill string 18 and the drill bit 14 together may generally be referred to as drilling in a "rotating mode," which generally maintains the directional heading of the rotary drill bit 14 and serves to produce a straight section of the wellbore 12, e.g., vertical section 12*a* and tangent section 12*c*. In exemplary embodiments, the directional drilling tool 100 may be employed to correct any unintentional deviations from the generally straight trajectory of the vertical section 12*a* and/or tangent section 12*c*.

In contrast to the rotating mode, a "sliding mode" may be employed to change the direction of the rotary drill bit 14 and thereby produce a curved section of the wellbore 12, e.g., build section 12*b*. In some exemplary embodiments, the drill string 18 may include a bent sub or housing (not explicitly identified) coupled therein to generally define the direction of drilling. In some exemplary embodiments, the drilling tool 100 may be employed to perform any course corrections as necessary along the build section 12*b*. Although a "sliding mode" generally refers to producing a curved section of a wellbore with a bent sub or housing (not explicitly identified), those skilled in the art will appreciate that in one or more embodiments, that a steering mechanism 102 (FIG. 2) of the directional drilling tool 100 may be employed without a bent sub or housing to define the direction of drilling.

To operate in sliding mode, the turn table 28 may be locked such that the drill string 18 does not rotate about the longitudinal axis $X_0$, and the rotary drill bit 14 may be rotated with respect to the drill string 18. To facilitate rotation of the rotary drill bit 14 with respect to the drill string 18, a bottom hole assembly or BHA 32 is provided in the drill string 18 at a downhole location in the wellbore 12. The BHA 32 may include a downhole motor that generates torque in response to the circulation of a drilling fluid, such as mud 36, therethrough. The BHA 32 may include or support the bent sub or housing (not explicitly identified) thereon.

The mud 36 can be pumped downhole by mud pump 38 through an interior of the drill string 18. The mud 36 passes through the downhole motor of the BHA 32 where energy is extracted from the mud 36 to turn the rotary drill bit 14. As the mud 36 passes through the BHA 32, the mud 36 may lubricate bearings (not explicitly shown) defined therein before being expelled through nozzles (not explicitly shown) defined in the rotary drill bit 14. The mud 36 lubricates the rotary drill bit 14 and flushes geologic cuttings and/or other debris from the path of the rotary drill bit 14. The mud 36 is then returned through an annulus 40 defined between the drill string 18 and the geologic formation "G." The geologic cuttings and other debris are carried by the mud 36 to the surface location "S" where the cuttings and debris can be removed from the mud stream.

As indicated above, the terms "rotating mode" and "sliding mode" are generally associated with drilling systems employing a mud motor and a bent housing. As one skilled in the art will appreciate, aspects of the disclosure may be practiced with other types of drilling systems as well. For example, in some exemplary embodiments, the directional drilling tool 100 may include rotary steerable systems having a steering mechanism 102 (FIG. 2) for selectively defining the direction of drilling through both straight and/or curved sections of the wellbore 12.

The directional drilling tool 100 includes an elongate housing 104 defining a housing axis $X_1$ therethrough. The steering mechanism 102 is operably coupled to the bit shaft 106 for selectively moving the drill bit 14 between a central position and at least one laterally offset position with respect to the elongate housing 104. In some exemplary embodiments as illustrated, the steering mechanism 102 is operable to pivot a rotational drill bit axis $X_2$ between an aligned configuration with respect to the housing axis $X_1$ and at least one offset configuration with respect to the housing axis $X_1$. In other exemplary embodiments, the steering mechanism 102 may be operable to laterally offset the drill bit axis $X_2$ with respect to the housing axis $X_1$ while maintaining a generally parallel relation between the axes $X_1$ and $X_2$.

The steering mechanism 102 may include any mechanical, hydraulic, pneumatic, electrical or other types of actuators commonly used in the art for controlling the angle or lateral position of the drill bit 14 with respect to the elongate housing 104 of directional drilling tool 100. As described in greater detail below, when the steering mechanism 102 is employed to pivot the drill bit axis $X_2$ to an offset configuration, the geologic formation "G" applies lateral reactive forces "F" to the drill bit 14. In accordance with aspects of the present disclosure, a steering force control mechanism 128 (see FIG. 3A) may be provided to counteract the reactive forces "F" within the directional drilling tool 100.

Figure 2:
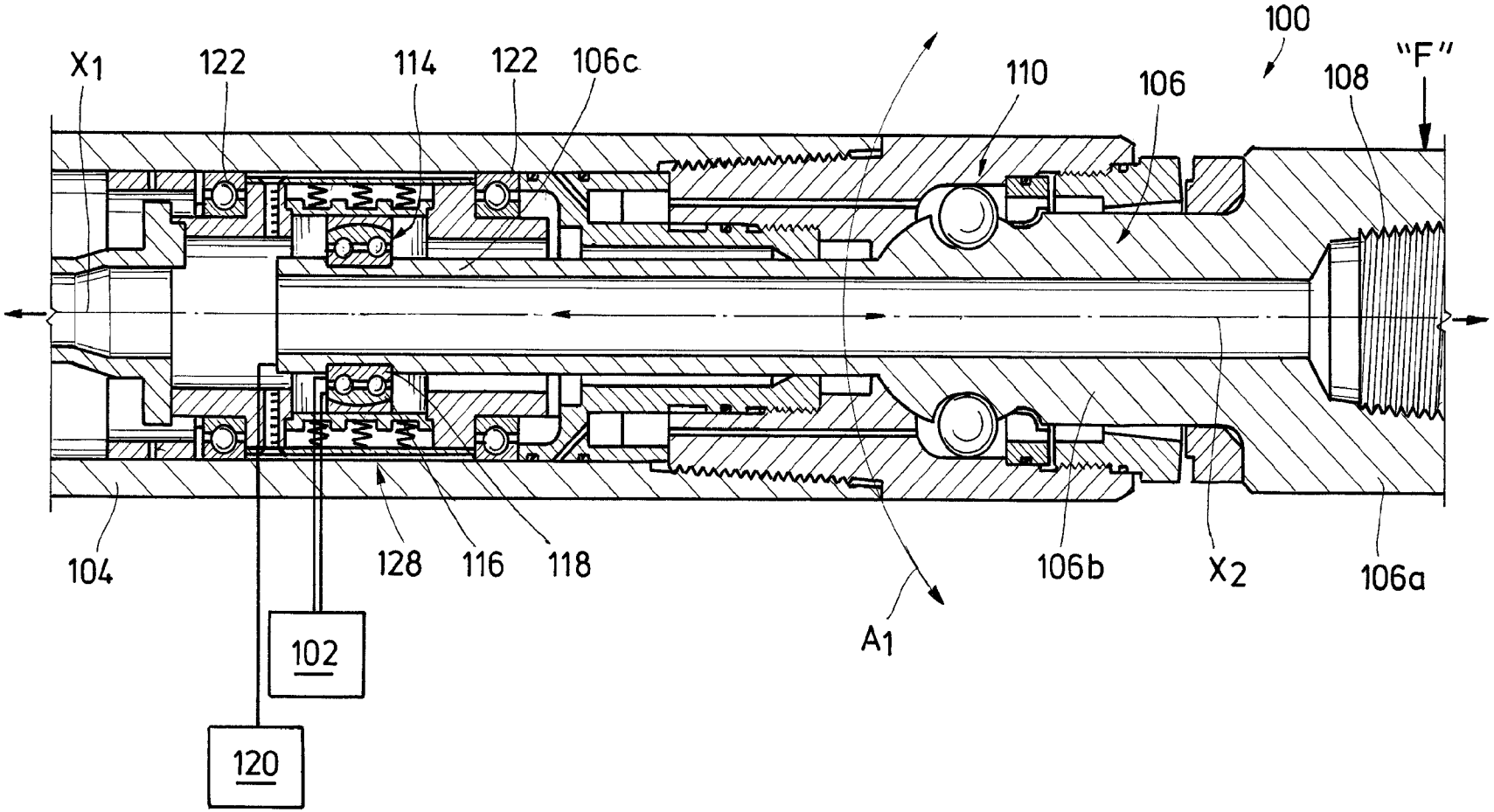
FIG. 2 is a cross-sectional side view of the downhole directional drilling system of claim 1 illustrating the steering force control mechanism radially supporting a cam mechanism with a plurality of preloaded flexible members or springs for counteracting lateral reaction forces applied to the drill bit.

Referring now to FIG. 2, the directional drilling tool 100 includes elongate housing 104. The elongate housing 104 can attach in line with the drill string 18 (FIG. 1) such that a housing axis $X_1$ defined generally along a centerline of the elongate housing 104 is generally co-extensive with the longitudinal axis $X_0$ (FIG. 1) within the elongate housing 104. A bit shaft 106 extends at least partially into the elongate housing 104 and is rotatably supported therein about a drill bit axis $X_2$. In some exemplary embodiments, the bit shaft 106 is rotatably supported in the elongate housing 104 such that the bit shaft 106 rotates with respect to the elongate housing 104, e.g., the elongate housing 104 may remain rotationally stationary with respect to the longitudinal axis $X_0$ within the wellbore while the bit shaft rotates 106 rotates generally the drill bit axis $X_2$. In some other exemplary embodiments, the bit shaft 106 rotates together with the elongate housing 104.

In some exemplary embodiments, a lower end 106$_a$ of the bit shaft 106 includes a connector 108 such a threads another mechanism for coupling the drill bit 14 (FIG. 1) thereto such that the drill bit 14 and the bit shaft 106 rotate together about the drill bit axis $X_2$. A central portion 106*b* of the bit shaft 106 is supported within the elongate housing 104 by a pivot joint 110. The pivot joint 110 supports rotational movement of the bit shaft 106 about the drill bit axis $X_2$ while permitting pivotal motion of the bit shaft 106 within the elongate housing 104. For example, the pivot joint 110 supports pivotal motion of the bit shaft 106 and rotational bit axis $X_2$ generally in the direction of arrows $A_1$. In one or more exemplary embodiments, the pivot joint 110 is a constant velocity joint, which facilitates the transmission of torque to the drill bit 14 through the bit shaft 106 at a variable angle with respect to elongate housing 104. The upper end 106*c* of the bit shaft 106 may be is supported by a cam mechanism 114. In some embodiments, the cam mechanism is selectively operable to induce pivotal motion in the bit shaft 106 by imparting a radial displacement to the upper end 106*c* of the bit shaft 106. In some other exemplary embodiments, the cam mechanism 114 may support the upper end 106*c* of the bit shaft 106 at a fixed radial position within the elongate housing 104.

In some exemplary embodiments, the cam mechanism 114 is an eccentric cam mechanism including an eccentric inner ring 116 and an outer ring 118. The upper end 106*c* of the bit shaft 106 is received within the inner ring 116 such that the relative rotational positions of the eccentricity of the inner ring 116 and outer ring 118 may define the radial position of the upper end 106*c* of the bit shaft 106 within the elongate housing 104. The steering mechanism 102 may include actuators for selectively rotating the inner and outer rings 116, 118 to control a radial offset of the upper end 106*c* of the bit shaft 106 to pivot the bit shaft 106 about the pivot joint 110. In this manner the bit shaft 106 is movable between an aligned configuration wherein the bit axis $X_2$ is aligned with the housing axis $X_1$ and at least one offset configuration wherein the bit axis $X_2$ is obliquely arranged with respect to the housing axis $X_1$. In this manner, the actuators of the steering mechanism 102 may control a magnitude of the steering force applied to the bit shaft 106 by rotating the inner ring 116 relative to the outer ring 118.

The bit shaft 106 is also operably coupled to a rotational driver 120 for selectively rotating the bit shaft 106 (and the drill bit 14) about the bit axis $X_2$. In exemplary embodiments, the rotational driver 120 may include a mud motor (not shown) or electric motor (not shown) disposed within the drill string 18, the turn table 28 (FIG. 1), or another mechanism recognized in the art. The rotational driver 120 may rotate the bit shaft 106 when the bit axis $X_2$ is aligned with the housing axis $X_1$ and/or when the bit axis $X_2$ is obliquely arranged with respect to the housing axis $X_1$. In some other exemplary embodiments, the rotational driver 120 may be operably and/or selectively coupled to the elongate housing 104 for rotating the elongate housing 104 together with the bit shaft 106.

Bearings 122 are provided between the cam mechanism 114 and the elongate housing 104 to permit relative rotation of the cam mechanism 114 and the elongate housing 104, and in some exemplary embodiments, the bearings 122 comprise ball bearings disposed in generally circular races. The bearings 122 may facilitate maintaining a steering force control mechanism 128 supported by the bearings 122 at a generally geostationary position. In other embodiments, e.g., where the elongate housing 104 is maintained in a geostationary position to generate a curved wellbore section, the bearings 122 may be eliminated and the steering force control mechanism 128 may be rotationally fixed with respect to the elongate housing 104.

Figure 3A:
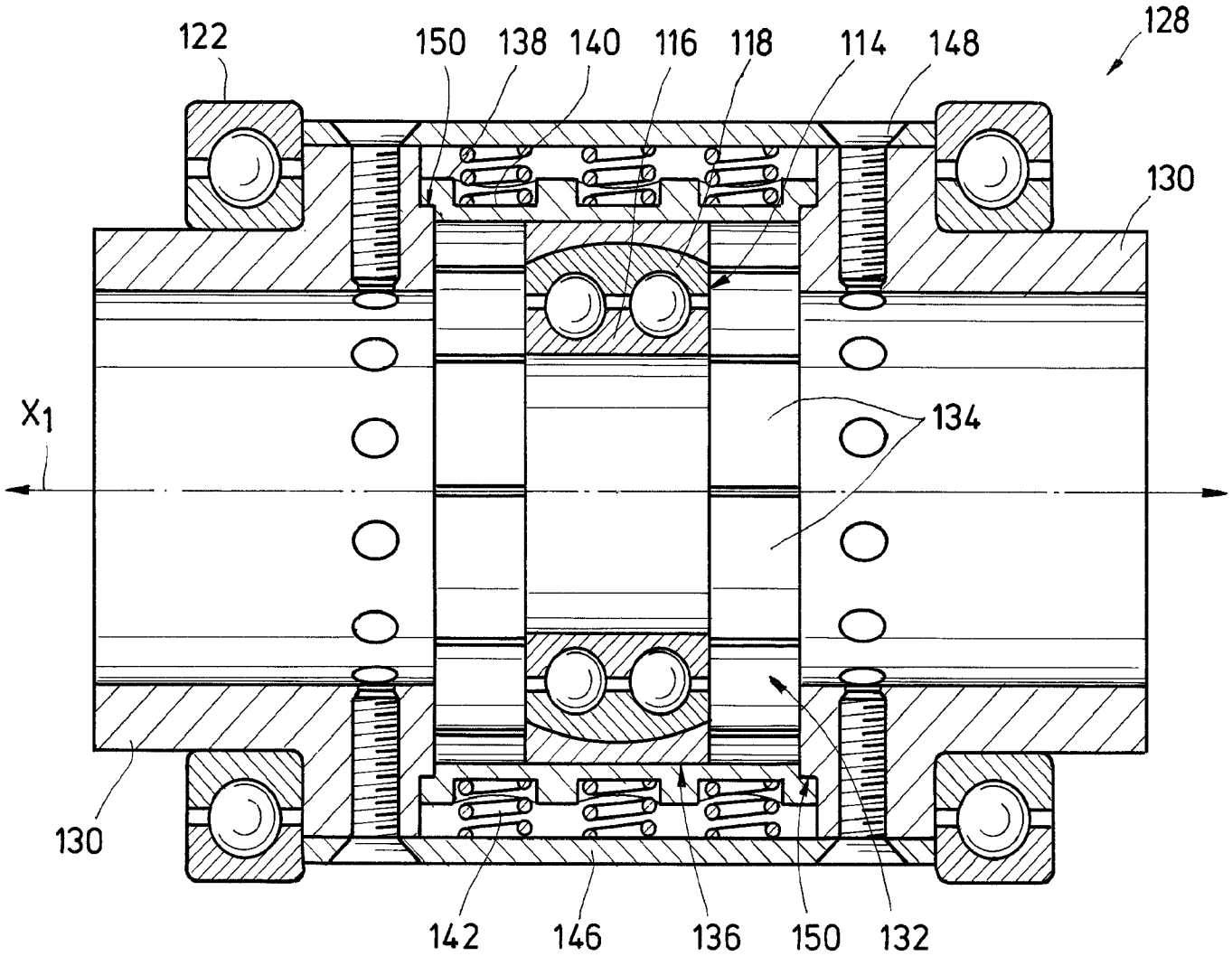
FIG. 3A is an enlarged cross-sectional side view of the steering force control mechanism of FIG. 2 illustrating the plurality of springs disposed between a segmented sleeve and a compression sleeve.

Referring to FIG. 3A, the cam mechanism 114 is radially supported by a steering force control mechanism 128. The steering force control mechanism 128 includes a pair of bezels 130 each rotatably supportable in the elongate housing 104 (FIG. 2) by the respective bearings 122. A segmented sleeve 132 is provided longitudinally between the bezels 130, and includes a plurality of circumferentially spaced segments 134. The outer ring 118 of the cam mechanism 114 may be disposed radially within the segmented sleeve 132 such that a radially outer surface 136 of the outer ring 118 engages each of the segments 134. In some exemplary embodiments, the radially outer surface 136 of the outer ring 118 may be generally cylindrical. In some exemplary embodiments, a radially outer surface 138 of each of the segments 134 includes one or more pockets 140 defined therein.

The pockets 140 each receive and support one end of a flexible member 142 therein. As used herein, the term "flexible member" describes a semi-rigid object that is readily deformed from its normal shape by the application of relatively light compressive force. For instance the "flexible members" described herein are sized, shaped and/or constructed of materials to permit the flexible member 142 to respond to lateral forces applied thereto with relatively greater deformation or flexure in the lateral direction than the elongate housing 104 and bit shaft 106, between which the flexible member 142 is coupled. In some exemplary embodiments, the flexible members 142 may be a helical compression spring or other biasing member recognized in the art. A compression sleeve 146 is disposed around the bezels 130, and may be secured thereto by threaded fasteners 148. The compression sleeve 136 engages an end of the flexible members 142 opposite the pockets 140 such that a preload may be maintained in the flexible members 142. For example, the compression sleeve 136 may be spaced radially from the pocket 140 by a distance such that the flexible members 142 may be maintained in a partially compressed configuration. In a partially compressed configuration the flexible members 142 exert opposed radial forces on the segmented sleeve 132 and the compression sleeve 146. The radial forces applied by the flexible members 142 press each of the segments into a pair of radial shoulders 150 defined on the bezels 130.

In some exemplary embodiments, the compression sleeve 146 extends continuously around the bezels 130, and in some exemplary embodiments, the compression sleeve 146 is segmented into two or more segments (not shown) to permit the flexible members 142 to be maintained in a preloaded configuration.

Figure 3B:
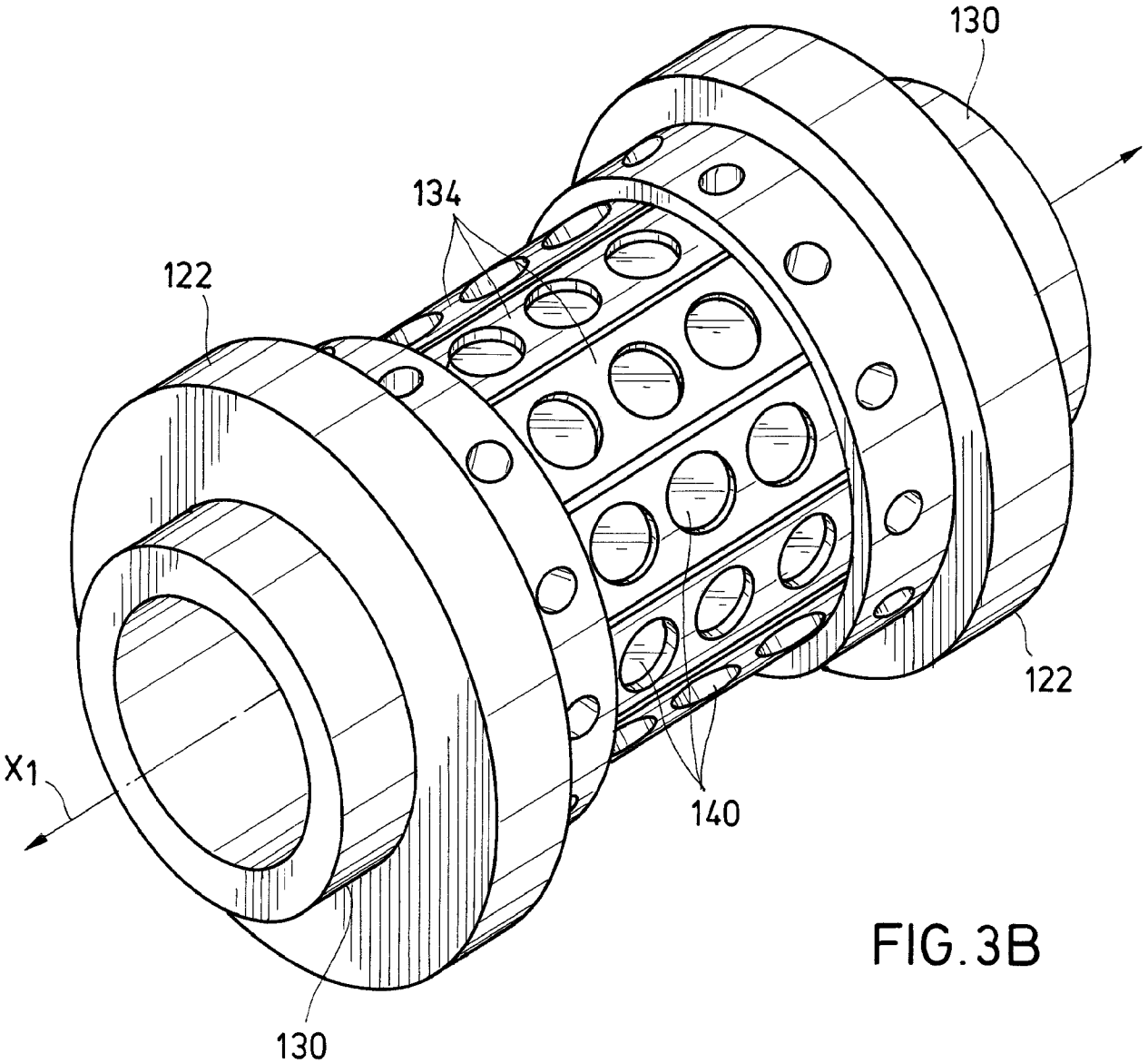
FIG. 3B is a partial, perspective view of the steering force control mechanism of FIG. 2 with the compression sleeve removed.

Referring to FIG. 3B, in the illustrated embodiment, the segments 134 are configured such that about twelve (12) segments 134 are disposed around the housing axis $X_1$. It should be appreciated that embodiments having more or fewer segments 134 are also contemplated. For example, in some embodiments, four (4) orthogonally arranged segments 134, e.g., circumferentially spaced by about 90 degrees from one another, may be provided, and in some other embodiments, eight (8) segments 134 are disposed about the housing axis $X_1$ are circumferentially spaced at about 45 degrees from another.

Example Operation

Referring again to FIG. 2, the bit shaft 106 may be rotated within the elongated housing by employing rotational driver 120. The steering mechanism 102 may be employed to pivot the bit shaft 106 in the direction of arrow $A_1$ about the pivot joint 110 such that lateral reactive forces "F" are then be imparted to the lower end 106*a* of the bit shaft 106 by the geologic formation "G" (FIG. 1). The reactive forces "F" are transmitted through the bit shaft 106 to the cam mechanism 114, which is radially supported by the segmented sleeve 132 and the preloaded flexible members 142 of the steering force control mechanism 128. When the preload applied to the flexible members 142 is sufficient to counteract the reactive forces "F," there is no lateral movement of the inner and outer rings 116, 118 of the cam mechanism 114. When the preload applied to the flexible members 142 is not sufficient to counteract the reactive forces "F," the flexible members 142 will flex or compress. The inner and outer rings 116, 118, at least one of the segments 134, and the upper end of the bit shaft 106 will be radially displaced in the direction opposite the reactive forces "F" as the bit shaft pivots about the pivot joint 110. This pivotal movement induces the radial displacement of the inner and outer rings 116, 118 and the segment(s) 134 away from the radial shoulders 150 (FIG. 3A). This movement limits the amount of force that can be applied by the steering mechanism 102 to the lower end of the bit shaft 106, and thereby limits bearing forces realized between the inner outer rings 116, 118 of the cam mechanism 114, and other bearings surfaces, e.g., bearings 122, in the directional drilling tool 100.

Figure 4:
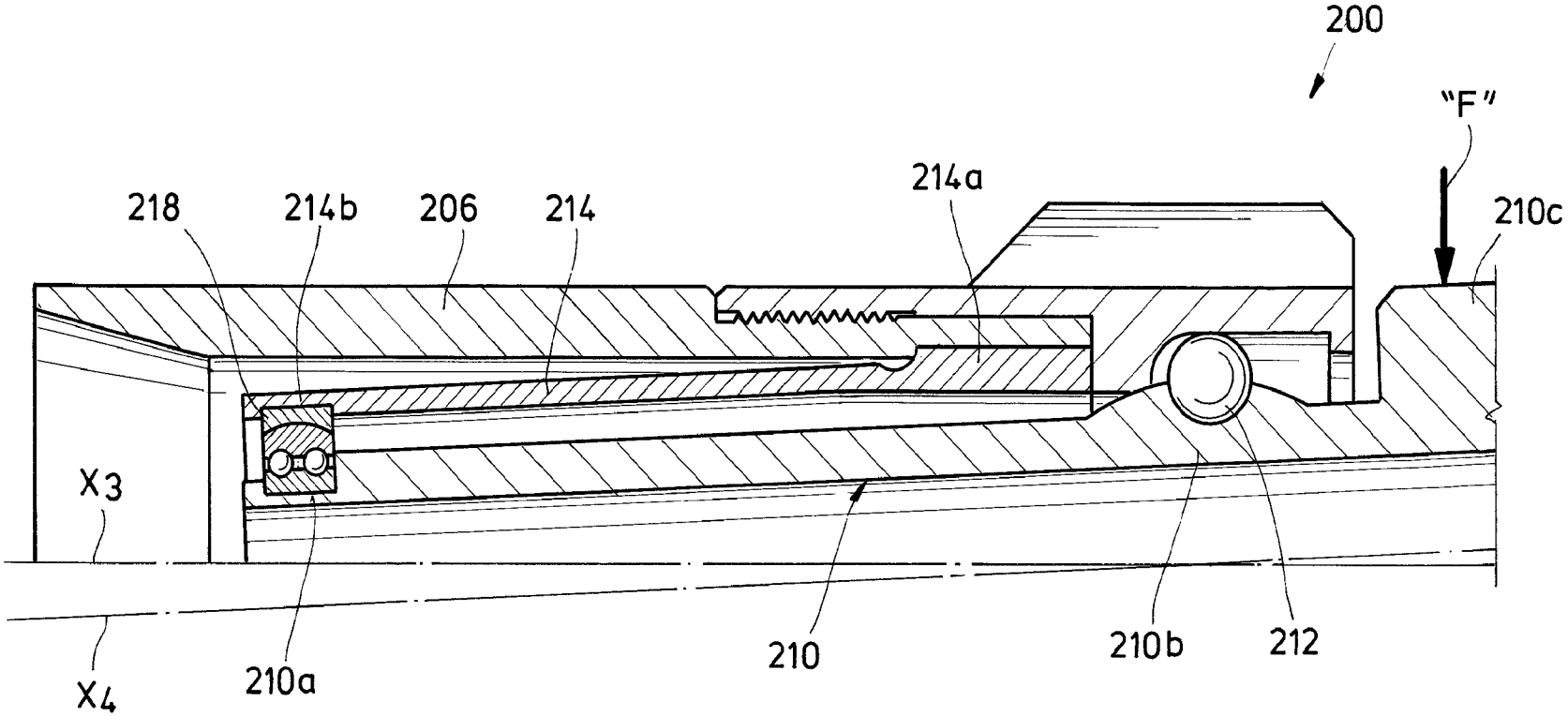
FIG. 4 is a partial, cross-sectional side view of a downhole tool including a steering force control mechanism with a cantilevered flexible member for counteracting lateral reaction forces applied to the drill bit in accordance with one or more alternate example embodiments of the disclosure.

Referring to FIG. 4, some other embodiments of a directional drilling tool 200 include an elongate housing 206 and a bit shaft 210 rotatably supported therein. The elongate housing 206 defines a housing axis $X_3$ and the bit shaft 210 defines a bit axis $X_4$ about which the bit shaft 210 is rotatable. A pivot joint 212 is defined between the bit shaft 210 and the elongate housing 206 which supports a central portion 210*b* of the bit shaft 210 in at least an aligned configuration wherein the bit axis $X_4$ is aligned with the housing axis $X_3$ and an at least one offset configuration (as illustrated) wherein the bit axis $X_4$ is obliquely arranged with respect to the housing axis $X_3$.

A flexible member 214 is supported within an elongate housing 206. The flexible member 214 may be an elongate cantilever affixed to an inner surface of the elongate housing 206 at a first end 214*a* and engaged with a cam mechanism 218 at a second end 214*b*. Although only one flexible member 214 is illustrated, a plurality of flexible members 214 may be circumferentially spaced about the elongate housing 206. The cam mechanism 218 is operably coupled to an upper end 210*a* of a bit shaft 210 to selectively laterally offset the upper end 210*a* of the bit shaft 210, to thereby pivot the bit shaft 210 about the pivot joint 210. The flexible members 214 may be preloaded to apply a radial inward force on the cam mechanism such that the radial position of the cam mechanism 218 in the elongate housing 206 is maintained in response to lateral forces "F" applied to the lower end 210*c* of the bit shaft 210 less than the predetermined threshold force. The preload may be selected and implemented such that the flexible members 214 are induced to flex and to permit the cam mechanism 218 to move radially under the influence of the lateral forces "F" applied to the lower end 210*c* of the bit shaft 210 greater or equal to the predetermined threshold force.

In some exemplary embodiments, the preload may be increased by increasing an outer diameter of the cam mechanism 218 and decreased by decreasing the outer diameter of the cam mechanism 218. In some exemplary embodiments, the preload may also be adjusted by selecting the size, shape and material characteristics of the flexible members 214. The aspects of the disclosure described in this section are provided to describe a selection of concepts in a simplified form that are described in greater detail above. This section is not intended to identify key features or essential features of the claimed subject matter, nor is it intended to be used as an aid in determining the scope of the claimed subject matter.

In one aspect, the disclosure is directed to a directional drilling system including a bit shaft and a drill bit coupled to a lower end of the bit shaft. An elongate housing supports the bit shaft at least partially therein, and a rotational driver is operably coupled to at least one of the bit shaft and the elongate housing for selectively rotating the bit shaft and the drill bit in a wellbore. At least one flexible member is coupled between the elongate housing and the bit shaft such that the flexible member is induced to flex in response to lateral forces applied to the bit shaft greater than a predetermined threshold force.

In one or more exemplary embodiments, the at least one flexible member maintains a preload therein when coupled between the elongate housing and the bit shaft. The magnitude of the preload defines the predetermined threshold force.

In some embodiments, the at least one flexible member comprises a plurality of flexible members circumferentially spaced around the bit shaft. In some embodiments, the directional drilling system further includes a segmented sleeve disposed about the bit shaft. The segmented sleeve may include a plurality of circumferentially spaced segments, and each of the circumferentially spaced segments may support least one flexible member of the plurality of flexible members. In one or more exemplary embodiments, the directional drilling system further includes a compression sleeve disposed about the plurality of flexible members, and the compression sleeve is operable to maintain a preload in the plurality of flexible members. In one or more exemplary embodiments, the directional drilling system further includes a bezel member with a radial shoulder thereon, and each of the circumferentially spaced segments engages the radial shoulder under the influence of the preload in the plurality of flexible members. The circumferentially spaced segments are separable from the radial shoulder under the influence of the predetermined threshold force applied to the bit shaft. In one or more exemplary embodiments, the bezel member is rotatably supported in the elongate housing such that the bezel member may be maintained in a geostationary configuration upon rotation of the elongate housing with respect to the wellbore.

In some embodiments, the directional drilling system further includes a steering mechanism operable for selectively orienting at least one of the elongate housing, the bit shaft and drill bit with respect to the wellbore.

In one or more embodiments, the directional drilling system further includes a pivot joint defined between the bit shaft and the elongate housing. The pivot joint may support the bit shaft above the drill bit in at least an aligned configuration wherein a bit axis defined by the bit shaft is aligned with a housing axis defined by the elongate housing and the drill bit is in the central position, and in at least one offset configuration wherein the bit axis is obliquely arranged with respect to the housing axis and the drill bit is in the at least one laterally offset position.

In one or more embodiments, the steering mechanism includes an eccentric cam mechanism including an inner ring disposed within an outer ring such that the inner ring is rotatable with respect to the outer ring to pivot the bit shaft about the pivot joint. In some embodiments, the at least one flexible member is coupled radially between the outer ring and the elongate housing. In some exemplary embodiments, the at least one flexible member comprises at least one of the group consisting of a spring and an elongate cantilever engaged with the elongate housing.

According to another aspect, the disclosure is directed to a directional drilling tool, including a bit shaft defining a bit axis and including a connector for coupling a drill bit to a lower end thereof. An elongate housing defines a housing axis and supports the bit shaft at least partially therein. At least one flexible member is coupled between the elongate housing and the bit shaft such that the flexible member is induced to flex in response to lateral forces applied to the bit shaft greater than a predetermined threshold force.

In one or more embodiments, the directional drilling tool further includes a pivot joint defined between the bit shaft and the elongate housing. The pivot joint rotatably supports the bit shaft in at least an aligned configuration wherein the bit axis is aligned with the housing axis and in at least one offset configuration wherein the bit axis is obliquely arranged with respect to the housing axis. In some embodiments, the directional drilling tool further includes a cam mechanism within the elongate housing and operably coupled to an upper end of the bit shaft. The cam mechanism may be selectively operable to laterally offset the upper end of the bit shaft to pivot the bit shaft about the pivot joint. In one or more embodiments, the at least one flexible member is coupled between the cam mechanism and the elongate housing such that the at least one flexible member maintains the radial position of the cam mechanism in the elongate housing in response to lateral forces applied to the bit shaft less than the predetermined threshold force, and the cam mechanism is induced to move radially under the influence of a force applied to the bit shaft exceeding the predetermined threshold. In some embodiments, the directional drilling tool further includes a segmented sleeve disposed about the cam mechanism. The segmented sleeve may include a plurality of circumferentially spaced segments, the at least one flexible member includes a plurality of flexible members, and each of the circumferentially spaced segments supports least one flexible member of the plurality of flexible members. In one or more embodiments, the plurality of circumferentially spaced segments includes at least four segments circumferentially spaced from one another by about 90 degrees.

In one or more embodiments, the cam mechanism is supported by the elongate housing for rotation about the housing axis. In some embodiments, the at least one flexible member is an elongate cantilever supported within the elongate housing.

In another aspect, the a method of directional drilling includes (a) rotating a bit shaft supported by an elongate housing to drive a drill bit against a geologic formation, (b) steering the drill bit with respect to the geologic formation such that the geologic formation applies a lateral reaction force to the bit shaft through the drill bit, and (c) counteracting the lateral reaction force with at least one flexible member coupled between the bit shaft and the elongate housing such that the flexible member maintains a lateral position when the lateral reaction force is less than predetermined threshold force and is induced to flex in when the lateral reaction force is greater than the predetermined threshold force.

In some embodiments, the method further includes applying a preload to the at least one flexible member such the flexible member is induced to flex in response to lateral reaction forces exceeding a predetermined threshold and maintains a radial configuration in response to lateral reaction forces less than the predetermined threshold. In one or more embodiments, steering the bit includes rotating an inner ring of an eccentric cam mechanism within an outer ring of the eccentric cam mechanism to radially displace an upper end of the bit shaft and thereby pivot the bit shaft, and in some embodiments counteracting the lateral reaction force with the at least one flexible member comprises applying the preload to the outer ring of the eccentric cam mechanism.

According to another aspect, the present disclosure is directed to a method of directional drilling. The method includes (a) rotating a bit shaft within an elongate housing to drive a drill bit against a geologic formation, (b) pivoting the bit shaft about a central portion of the bit shaft within the elongate housing such that the geologic formation applies a lateral reaction force against a lower end of the bit shaft, and (c) counteracting the lateral reaction force with at least one flexible member disposed between an upper end of the bit shaft and the elongate housing.

In one or more embodiments, the method further includes applying a preload to the at least one flexible member such the flexible member is induced to flex in response to lateral reaction forces exceeding a predetermined threshold and maintains a radial configuration in response to lateral reaction forces less than the predetermined threshold. In some embodiments, pivoting the bit shaft includes rotating an inner ring of an eccentric cam mechanism within an outer ring of the eccentric cam mechanism to radially displace the upper end of the bit shaft, and counteracting the lateral reaction force with the at least one flexible member includes applying the preload to the outer ring of the eccentric cam mechanism.

In another aspect, the disclosure is directed to a directional drilling system including a drill bit and a steering mechanism with an associated control system for directing the drill bit along a well path. The steering mechanism operates to apply a steering force up to a predetermined threshold, and thereafter a mechanical steering force control mechanism limits the steering force to the predetermined threshold regardless of an angle of deflection induced by the steering mechanism.

In one aspect, the disclosure is directed to a directional drilling system including a drill bit and a bit shaft defining a bit axis with the drill bit. The drill bit is coupled to the bit shaft at a lower end thereof. An elongate housing defines a housing axis and rotatably supports the bit shaft at least partially therein. A pivot joint is defined between the bit shaft and the elongate housing. The pivot joint supports the bit shaft above the drill bit in at least an aligned configuration wherein the bit axis is aligned with the housing axis and an at least one offset configuration wherein the bit axis is obliquely arranged with respect to the housing axis. A rotational driver is operably coupled to the bit shaft for selectively rotating the bit shaft and the drill bit about the bit axis with respect to the elongate housing. A steering mechanism is operably coupled to the bit shaft for selectively pivoting the bit shaft about the pivot joint between the aligned configuration and the at least one offset configuration. The directional drilling system also includes at least one flexible member coupled between the elongate housing and the pivot shaft above the pivot joint such that the flexible member is induced to flex in response to lateral forces applied to the bit shaft greater than a predetermined threshold force.

Moreover, any of the methods described herein may be embodied within a system including electronic processing circuitry to implement any of the methods, or a in a computer-program product including instructions which, when executed by at least one processor, causes the processor to perform any of the methods described herein.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A directional drilling system, comprising:

a bit shaft;

a drill bit coupled to a lower end of the bit shaft;

an elongate housing supporting the bit shaft at least partially therein;

a rotational driver operably coupled to at least one of the bit shaft and the elongate housing for selectively rotating the bit shaft and the drill bit in a wellbore;

at least one flexible member coupled between the elongate housing and the bit shaft such that the flexible member is induced to flex in response to lateral forces applied to the bit shaft exceeding a predetermined threshold force, wherein the at least one flexible member comprises a plurality of flexible members circumferentially spaced around the bit shaft;

a segmented sleeve disposed about the bit shaft, wherein segmented sleeve comprises a plurality of circumferentially spaced segments and wherein each of the circumferentially spaced segments supports least one flexible member of the plurality of flexible members; and a compression sleeve disposed about the plurality of flexible members, the compression sleeve operable to maintain a preload in the plurality of flexible members.

2. The directional drilling system of claim 1, wherein the at least one flexible member maintains the preload therein when coupled between the elongate housing and the bit shaft, and wherein the preload defines the predetermined threshold force.

3. The directional drilling system of claim 1, further comprising a bezel member with a radial shoulder thereon, wherein each of the circumferentially spaced segments engage the radial shoulder under the influence of the preload in the plurality of flexible members, and wherein the circumferentially spaced segments are separable from the radial shoulder under the influence of the predetermined threshold force applied to the bit shaft.

4. The directional drilling system of claim 3, wherein the bezel member is rotatably supported in the elongate housing such that the bezel member may be maintained in a geostationary configuration upon rotation of the elongate housing with respect to the wellbore.

5. The directional drilling system of claim 1, further comprising a steering mechanism operable for selectively orienting at least one of the elongate housing, the bit shaft and drill bit with respect to the wellbore.

6. The directional drilling system of claim 5, further comprising a pivot joint defined between the bit shaft and the elongate housing, the pivot joint supporting the bit shaft above the drill bit in at least an aligned configuration wherein a bit axis defined by the bit shaft is aligned with a housing axis defined by the elongate housing, and in at least one offset configuration wherein the bit axis is obliquely arranged with respect to the housing axis and the drill bit is in a laterally offset position.

7. The directional drilling system of claim 6, wherein the steering mechanism comprises an eccentric inner ring disposed within an outer ring, and wherein the inner ring is rotatable with respect to the outer ring to pivot the bit shaft about the pivot joint.

8. A directional drilling system, comprising:

a bit shaft;

a drill bit coupled to a lower end of the bit shaft;

an elongate housing supporting the bit shaft at least partially therein;

a rotational driver operably coupled to at least one of the bit shaft and the elongate housing for selectively rotating the bit shaft and the drill bit in a wellbore;

at least one flexible member coupled between the elongate housing and the bit shaft such that the flexible member is induced to flex in response to lateral forces applied to the bit shaft exceeding a predetermined threshold force;

a steering mechanism operable for selectively orienting at least one of the elongate housing, the bit shaft and drill bit with respect to the wellbore, wherein the steering mechanism comprises an eccentric inner ring disposed within an outer ring, and wherein the inner ring is rotatable with respect to the outer ring to pivot the bit shaft about the pivot joint;

wherein the at least one flexible member is coupled radially between t e outer ring and the elongate housing.

9. A directional drilling tool, comprising:

a bit shaft defining a bit axis and comprising a connector for coupling a drill bit to a lower end thereof;

an elongate housing defining a housing axis and supporting the bit shaft at least partially therein;

at least one flexible member coupled between the elongate housing and the bit shaft such that the flexible member is induced to flex in response to lateral forces applied to the bit shaft greater than a predetermined threshold force;

a pivot joint defined between the bit shaft and the elongate housing, the pivot joint rotatable supporting the bit shaft in at least an aligned configuration wherein the bit axis is aligned with the housing axis and in at least one offset configuration wherein the bit axis is obliquely arranged with respect to the housing axis; and a cam mechanism within the elongate housing and operably coupled to an upper end of the bit shaft, the cam mechanism selectively operable to laterally offset the upper end of the bit shaft to pivot the bit shaft about the pivot joint;

wherein the at least one flexible member is coupled between the cam mechanism and the elongate housing such that the at least one flexible member maintains the radial position of the cam mechanism in the elongate housing in response to lateral forces applied to the bit shaft less than the predetermined threshold force and wherein the cam mechanism is induced to move radially under the influence of the predetermined threshold force applied to the bit shaft.

10. The directional drilling tool of claim 9, further comprising a segmented sleeve disposed about the cam mechanism, wherein segmented sleeve comprises a plurality of circumferentially spaced segments, wherein the at least one flexible member comprises a plurality of flexible members, and wherein each of the circumferentially spaced segments supports least one flexible member of the plurality of flexible members.

11. The directional drilling tool of claim 9, wherein the at least one flexible member is an elongate cantilever supported within the elongate housing.

12. A method of directional drilling, comprising rotating a bit shaft supported by an elongate housing to drive a drill bit against a geologic formation;

steering the drill bit with respect to the geologic formation such that the geologic formation applies a lateral reaction force to the bit shaft through the drill bit; and counteracting the lateral reaction force with at least one flexible member coupled between the bit shaft and the elongate housing such that the flexible member maintains a lateral position when the lateral reaction force is less than predetermined threshold force and is induced to flex from the lateral position when the lateral reaction force exceeds the predetermined threshold force; and applying a preload to the at least one flexible member such that the flexible member is induced to flex in response to lateral reaction forces greater than a predetermined threshold and maintains a radial configuration in response to lateral reaction forces less than the predetermined threshold force;

wherein steering the bit comprises rotating an inner ring of an eccentric cam mechanism within an outer ring of the eccentric cam mechanism to radially displace an upper end of the bit shaft and thereby pivot the bit shaft, and wherein counteracting the lateral reaction force with the at least one flexible member comprises applying the preload to the outer ring of the eccentric cam mechanism.

* * * * *